US005828346A

United States Patent [19]

Park

[11] Patent Number: 5,828,346

[45] Date of Patent: Oct. 27, 1998

[54] CARD ANTENNA

[75] Inventor: Tah Joon Park, Busan, Rep. of Korea

[73] Assignee: Samsung Electro-Mechanics Co., Ltd., Suwon, Rep. of Korea

[21] Appl. No.: 692,049

[22] Filed: Aug. 2, 1996

[30] Foreign Application Priority Data

May 28, 1996 [KR] Rep. of Korea ..... 1996-18183

[51] Int. Cl.[6] ..... H01Q 1/38; H01Q 3/24

[52] U.S. Cl. ..... 343/826; 343/702; 343/853; 343/876

[58] Field of Search ..... 343/826, 702, 343/700 MS, 853, 876; H01Q 1/24, 1/38, 3/24

[56] References Cited

U.S. PATENT DOCUMENTS 5,160,936 11/1992 Braun et al. ..... 343/700 MS 5,548,837 8/1996 Hess et al. ..... 343/757

5,657,028 8/1997 Sanad ..... 343/702

FOREIGN PATENT DOCUMENTS 0610025 8/1994 European Pat. Off. .

*Primary Examiner*—Michael C. Wimer

*Attorney, Agent, or Firm*—Ladas & Parry

[57] ABSTRACT

A fading phenomenon is eliminated by integrally providing two monopole antennas on a printed circuit board, alternately feeding a high frequency signal to the two monopole antennas by a switching device, and differently forming distances and patterns of the two monopole antennas whereby making a diversity.

4 Claims, 5 Drawing Sheets

CARD ANTENNA

BACKGROUND OF THE INVENTION

1. Field of the Invention

The present invention relates to a card antenna, and more particularly to a card antenna for preventing a fading which changes a strength of wave in response to a location by making a diversity by forming card antenna used for portable radio communication set to both corners of printed circuit board.

2. Description of the Prior Art

A modem card of note book PC or a general PC executes a radio communication between main body wireless modem and above described modem card by providing a main body wireless modem to terminals capable of connecting to ISDN or PSIN so as to be able to do a radio communication.

Thus, a typical example executing a radio communication between the modem card and the main body wireless modem is disclosed in European Patent No.0 610 025 A1. As shown in FIG. 1(A) and (B), a PCMCIA (Personal Computer Memory Card International Association) wireless credit card modem 1 is connected by hinge 3 one another, which are made by two sections 2, 4 of credit card size. The first section 2 includes modem circuitry, and the second section 4 includes antenna and radio circuit. Two sections make 90 degree angle at open position. The section 2 having modem circuitry is inserted into a PCMCIA slot 5 of portable computer PC as shown in FIG. 1(B), and the second section 4 including an antenna is exposed to exterior of the computer.

A structure of the antenna used for such prior art wireless card is shown in FIG. 2(A) and (B).

FIG. 2(A) is a front surface of the modem card, and FIG. 2(B) is a rear surface of the modem card.

An antenna 10 is made to a state that front surface patterns 20, 20' and rear surface patterns 30, 30' are connected to one another through via holes 40. It is a monopole antenna fed from a power supply through a chip capacitor 50 attached at the rear surface of printing circuit board.

In such a conventionl antenna as this, since a fading phenomenon is produced by which the wave becomes weakened at a point about ¼ multiple of wave length due to a multi-path propagation interference effect, a receiving field strength in response to propagation state of wave is timely changed and thereby communication state becomes worse in case when a main body wireless modem is present at ¼ multiple point of wave length. And, since a transmitting signal is reached to a receiver through various paths in a radio system, an interference of reflected wave from ground surface and a direct wave may be present, and the reflected wave reflected by walls of building or space passing through wave make also factors of producing the interference. Particularly in an indoor space, a standing wave is formed due to multiple reflected waves, therefore there has been a problem that periodic fading phenomena are produced in case of moving within this area.

OBJECT AND SUMMARY OF THE INVENTION

Therefore, the present invention is directed to solve such problems as above, and it is an object of the present invention to provide a card antenna which prevents fading phenomenon caused by multi-path wave interference effect.

Another object of the present invention is to provide a card antenna which is set with a pair of monopole antennas on a printing circuit board whereby alternately feeding a high frequency signal to two monopole antennas by a switching device eliminates the fading phenomena.

Still other another object of the present invention is to provide a card antenna which is integrally set with a pair of monopole antennas on a printed circuit board and eliminates the fading phenomena by making a pattern diversity, e.g. by differently forming a length and shape of the two monopole antennas.

In order to accomplish above objects, an apparatus in accordance with the present invention is made such that a pair of monopole antennas are formed at both corners of one, e.g. upper end the printed circuit board, and a switching device is provided on the printed circuit board between them whereby a high frequency signal is alternately fed to the both side monopole antennas so that waves are emitted from both side monopole antennas.

DETAILED DESCRIPTION OF THE EMBODIMENTS

Hereinafter, the preferred embodiments of the present invention will be described more in detail with reference to the accompanying drawings.

Figure 1A:
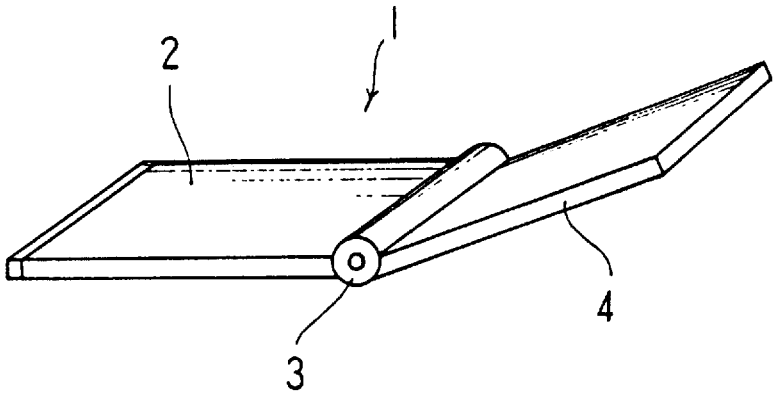
FIG. 1A PRIOR ART
FIG. 1(A) and (B) are perspective views of examples of prior art wireless modem card, FIG. 2(A) and (B) are fragmentary end views of antennas used for prior art wireless modem card, FIG. 3(A) and (B) are end views showing a structure of card antenna in accordance with the present invention.
Figure 1B:
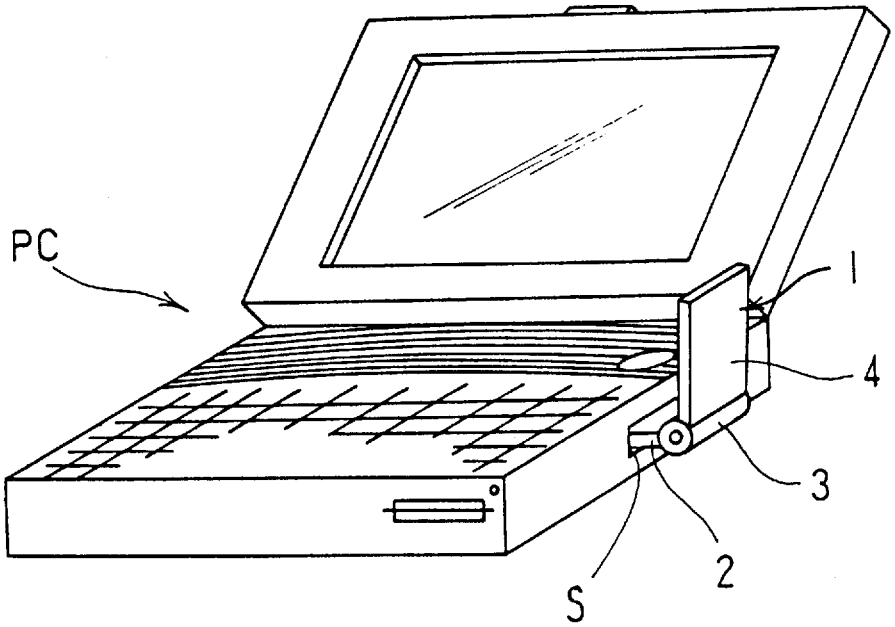
FIG. 1B PRIOR ART
Figure 2A:
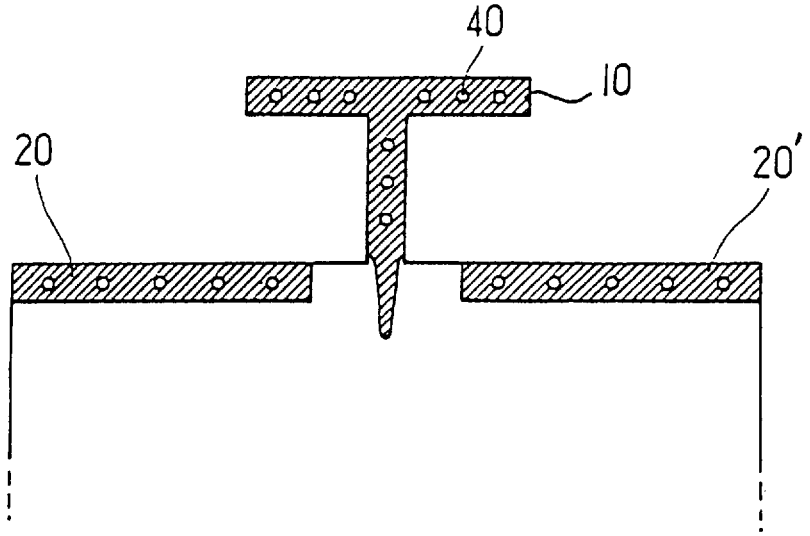
FIG. 2A PRIOR ART
Figure 2B:
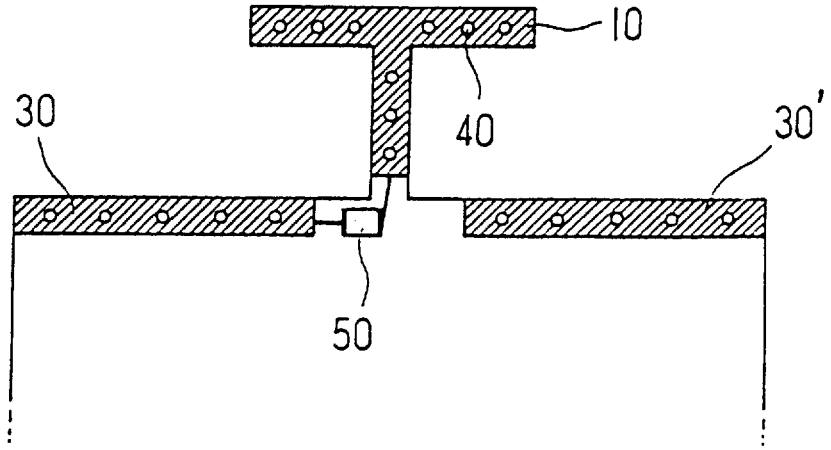
FIG. 2B PRIOR ART
Figure 3A:
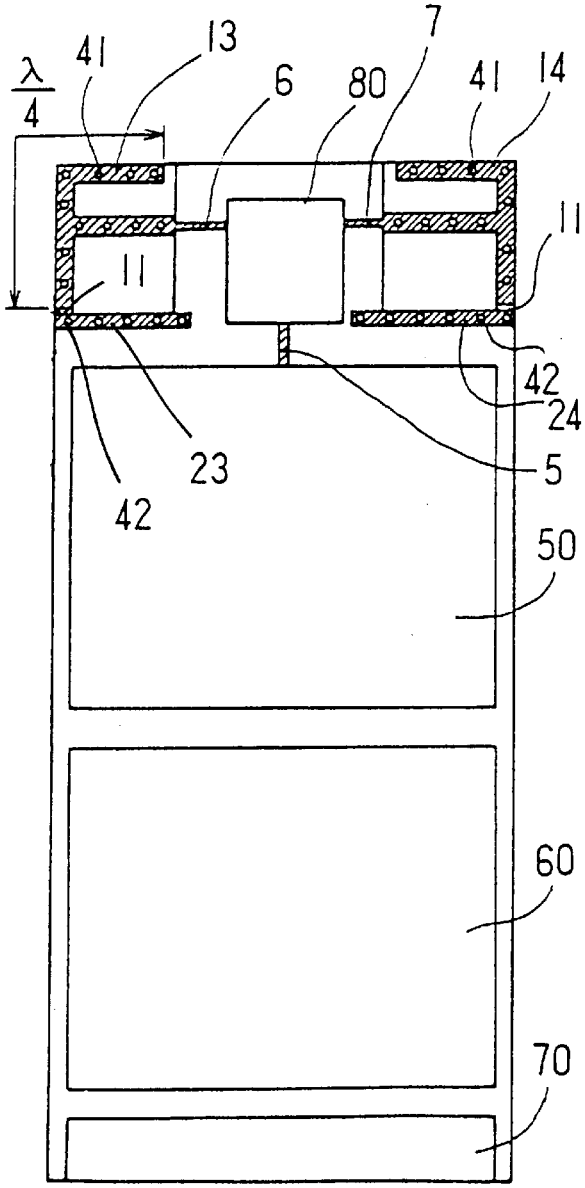

Structural drawings showing the structure of antenna in accordance with the present invention is shown in FIG. 3(A) and (B).

In the drawings, an antenna in accordance with the present invention is formed in an integral type on a printed circuit board of a modem card. Antenna elements 13, 14 have pattern diversity in "F"-shape and inverse "F"-shape at respective upper corners of the printed circuit board. Thin conductive patterns are adhered on front and rear surfaces of the antenna elements 13, 14, and the front surface and the rear surface are electrically connected by via holes 41, 42 . . .

A base portion and central branch portion of the antenna element 13, 14 are adhered to the printing circuit board and integrally formed, but the pattern on its surface is not electrically conductive. The antenna elements 13, 14 make predetermined gaps 11, 11 with patterns 23, 24 which extend and cover at uppermost portion on front surface, and making predetermined gaps 11', 11' with ground pattern 110 on rear surface.

Since a distance between an antenna element and another antenna element is left away about ¼ of 2.4 MHz frequency wave length, a space diversity can be made, and an antenna operating frequency can be decreased by adjusting a gap capacitor utilizing a distance between the antenna elements 13, 14 and entire ground of the modem card.

Figure 4:
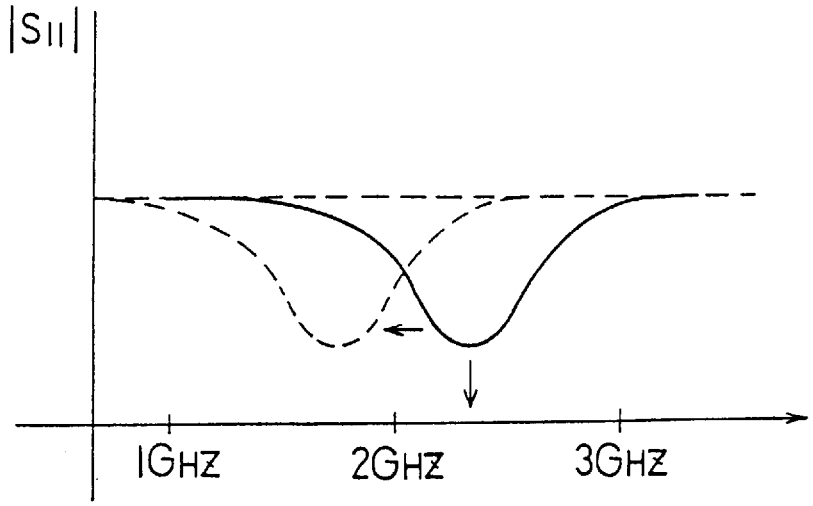
FIG. 4 is a graph illustrating a frequency in which a reflection coefficient becomes decreased by distance adjustment of gaps among antenna element pattern and ground pattern.
Figure 5:
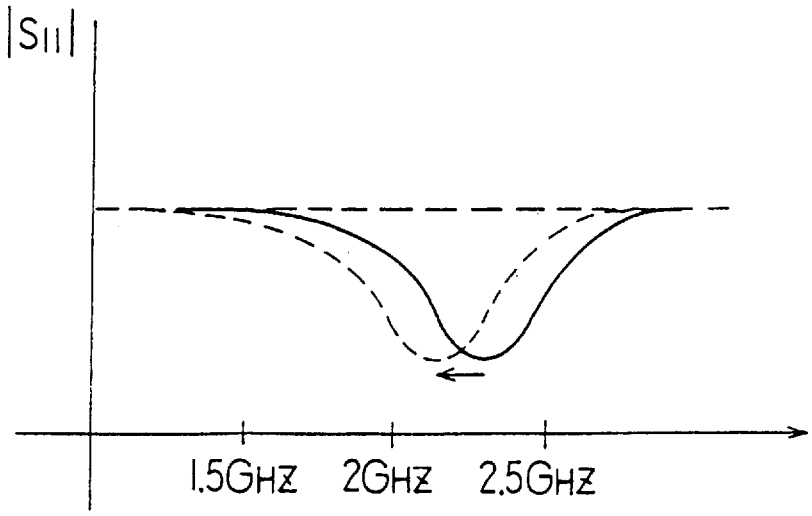
FIG. 5 is a graph illustrating a state that a reflection coefficient of the antenna element becomes decreased, FIG. 6(A) and (B) are fragmentary views of another embodiment of antenna in accordance with the present invention, and FIG. 7(A) and (B) are fragmentary views of still other embodiment of antenna in accordance with the present invention.

And, the reflection coefficient of the antenna elements 13, 14 can be decreased by adjusting the distance of said gaps 11, 11, 11', 11' as shown in FIG. 4, and the frequency to be decreased can also be changed.

On the front surface, the central branch portions of "F"-shape and inverse "F"-shape of the antenna elements 13, 14 are connected to a switching circuit section 80 through micro-strip lines 6, 7 respectively. Wherein the micro-strip lines 6, 7 are formed to be 50Ω. On the rear surface, the central branch portions of "F"-shape and inverse "F"-shape of the antenna elements 13, 14 are formed so as to make predetermined gaps 16, 17 with ground pattern 110 respectively.

Lengths of antenna elements 13, 14 are less than or equal to ¼ of wave length(≦λ/4), and which are formed at upper-ward left and right corners in the forms of "F"-shape and inverse "F"-shape so that waves are emitted to both sides of left and right.

The switching circuit section 80 receives a high frequency signal from a high frequency circuit section 50 by a feeder 5 formed by micro-strip line whereby feeds of the high frequency signal either to left side antenna element 13 or to right side antenna element 14 are by a control signal fed from a control section.

The control section 60 is disposed below the high frequency circuit section 50, and a connector section 70 is disposed at lowermost end portion.

Accordingly, the left side antenna element 13 and the right side antenna element 14 alternately emit the waves, and thereby a fading phenomenon capable of producing at a time when only one side antenna emits the wave and a fading phenomenon capable of producing at a time when only other side antenna emits the wave are overlapped, whereby consequently and periodically the fading phenomena weakening the strength of signal are prevented.

Figure 6A:
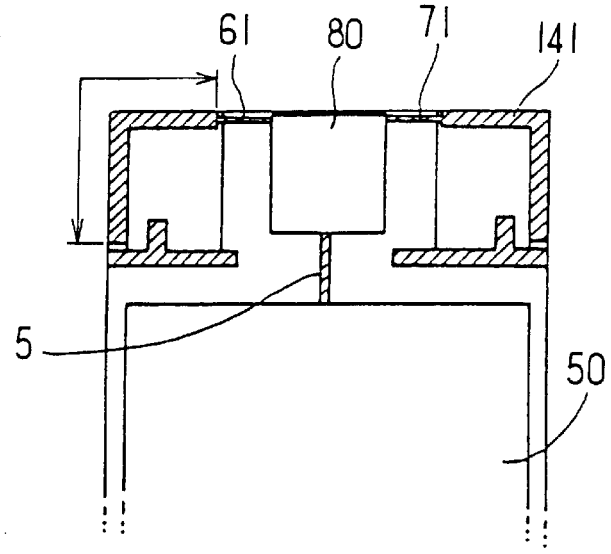

Another embodiment of antenna in accordance with the present invention is shown in FIG. 6(A) and (B).

Figure 3B:
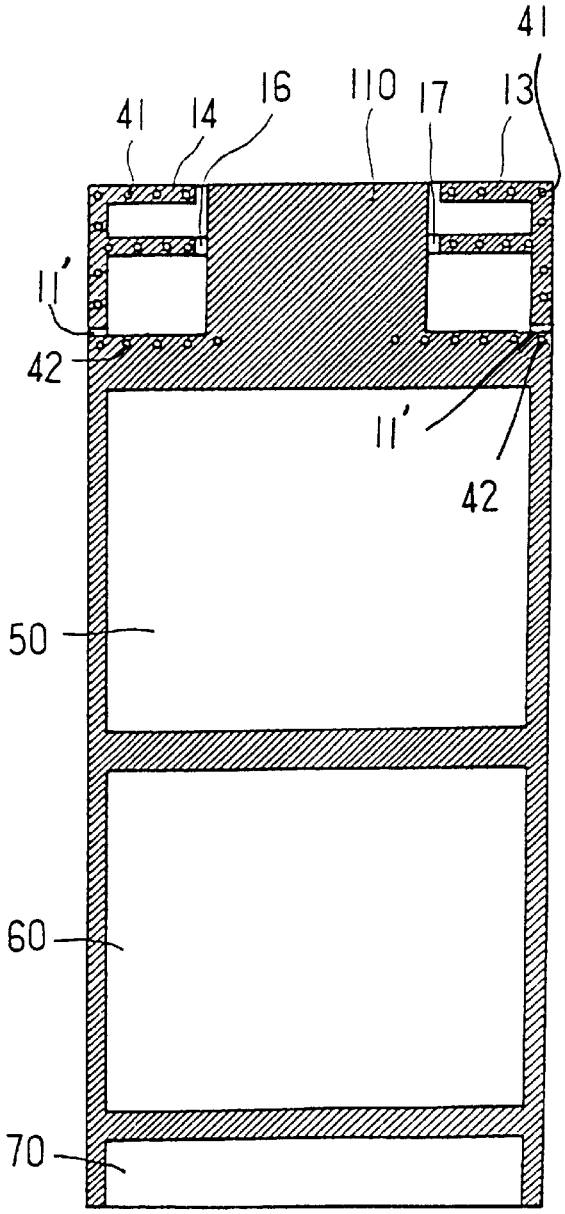
Figure 6B:
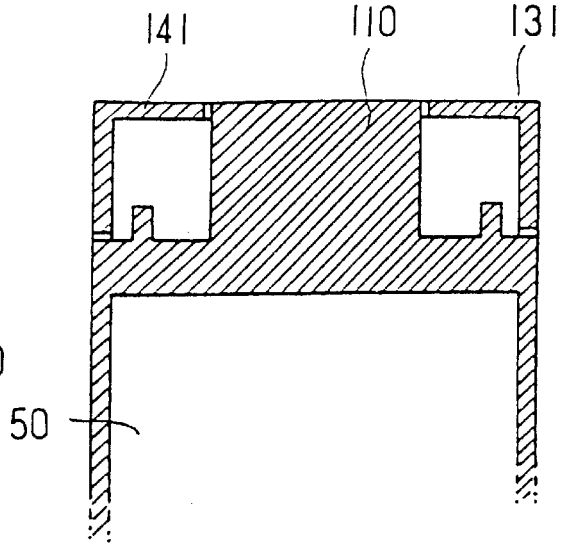

FIG. 6(A) shows a front surface of the printing circuit board, and FIG. 6(B) shows a rear surface of the printed circuit board. Here, parts and portions identical with parts and portions shown in FIG. 3 are explained by giving same reference numeral symbols, and parts or portions added with some changes are given with other reference numeral symbols so as to be able to discriminate.

Different points between this embodiment and previously explained embodiment are the points that the antenna elements 131, 141 have "フ"-shape which is not "F"-shape, and uppermost end portions of the antenna elements 131, 141 are connected to the switching circuit 80 by feeders 61, 71 respectively so as to receive the high frequency signal.

Figure 7A:
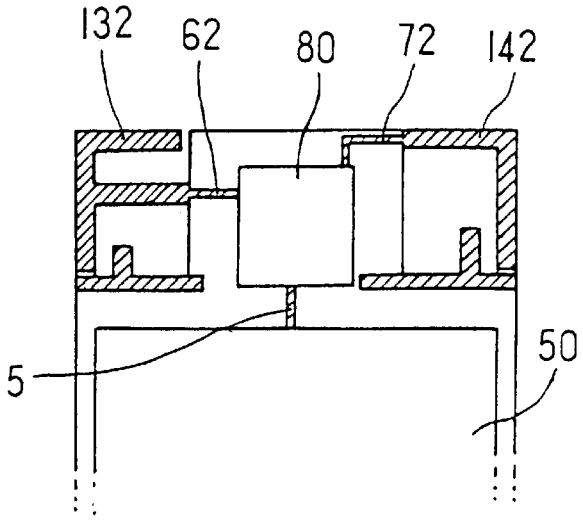

Still other embodiment of antenna in accordance with the present invention is shown in FIG. 7(A) and (B).

Figure 7B:
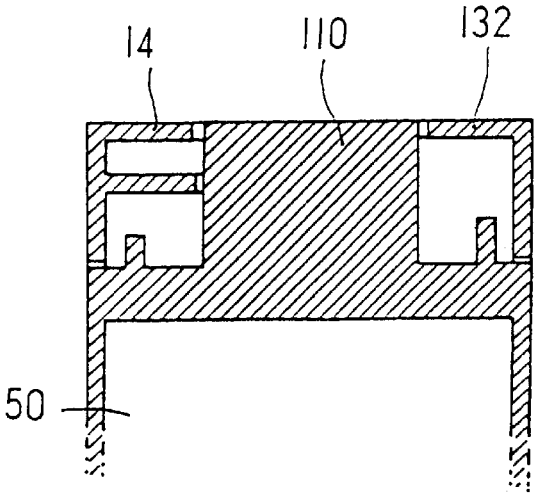

FIG. 7(A) shows a front surface of the printing circuit board, and FIG. 7(B) shows a rear surface of the printed circuit board. Here, parts and portions identical with parts and portions shown in FIG. 3 are explained by giving same reference numeral symbols, and parts or portions added with some changes are given with other reference numeral symbols so as to be able to discriminate.

Different points between this embodiment and previously explained embodiment are the points that the left side antenna elements 132 have "F"-shape which is identical with first embodiment, but the right side antenna element 142 is "フ"-shape which is identical with second embodiment.

The left side antenna element 132 is connected with central branch portion of "F"-shape through a micro-strip line 62 to the switching circuit section 80.

The right side antenna element 142 has "フ"-shape, and uppermost end portion of the antenna element 142 is connected to the switching circuit 80 through a feeder 72 whereby receives the high frequency signal. Similarly as before, the micro-strip lines 62, 72 are formed so as to be 50Ω.

As described above, the antenna elements are formed at both corners of the printing circuit board, but since a distance between the antenna element and another antenna element is left away about ¼ of 2.4 MHz frequency wave length, a space diversity can be made, and since disposition and pattern of two antenna elements are different one another, the pattern diversity is possible, and it is possible to make a structure into a state that the space diversity and the pattern diversity are mixed.

As described above, in accordance with the present invention, the antenna operating frequency is decreased by adjusting the gaps utilizing distance between the antenna element and entire ground of the modem card, so that a minimizing of the antenna can be made, and the antenna operating frequency can be finely adjusted.

What is claimed is:

1. A card antenna for emitting signals and receiving signals emitted from another card, said card antenna comprising:

a printed circuit board having opposite corners and front and rear surfaces;

two antenna elements respectively at the opposite corners of the printed circuit board, the antenna elements being thin, conductive, diverse patterns on the front and rear surfaces and spaced from each other about ¼ of a wavelength of signals to be emitted, wherein an operating frequency of each of the antenna elements is the same;

via holes through the printed circuit board for electrically connecting the thin, conductive, diverse patterns on the front and rear surfaces;

a switching circuit and at least one micro-strip line for switching connections of the antenna elements to a high frequency circuit for the signals; and a control for controlling the switching circuit to alternately feed the signals to the antenna elements and to receive other signals from the antenna elements.

2. The antenna as defined in claim 1, wherein the thin, conductive, diverse patterns are one of F-shape and inverse F-shape, inverse フ-shape and フ-shape, and F-shape and フ-shape.

3. The card antenna as defined in claim 1, and further comprising a ground pattern on the printed circuit board for forming a predetermined gap between the two antenna elements for adjusting the operating frequency.

4. The card antenna as defined in claim 2, and further comprising a ground pattern on the printed circuit board for forming a predetermined gap between the two antenna elements for adjusting the operating frequency.

* * * * *